US008844074B2

(12) United States Patent
Mohr et al.

(10) Patent No.: US 8,844,074 B2
(45) **Date of Patent: *Sep. 30, 2014**

(54) BED WEDGE

(71) Applicants: Brent A. Mohr, Boulder Creek, CA (US); Edward Peisner, Carson City, NV (US)

(72) Inventors: Brent A. Mohr, Boulder Creek, CA (US); Edward Peisner, Carson City, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/760,191

(22) Filed: Feb. 6, 2013

(65) Prior Publication Data

US 2014/0215716 A1 Aug. 7, 2014

Related U.S. Application Data

(63) Continuation of application No. 13/241,331, filed on Sep. 23, 2011, now Pat. No. 8,375,487.

(51) Int. Cl.
*A47C 21/00* (2006.01)
*A47B 23/00* (2006.01)

(52) U.S. Cl.
CPC ..... *A47C 21/00* (2013.01); *A47C 21/003* (2013.01); *A47B 23/00* (2013.01); *Y10S 5/904* (2013.01)
USPC ..... 5/507.1; 5/503.1; 5/658; 5/424; 5/904

(58) Field of Classification Search
USPC ..... 5/424, 658, 661, 663, 52, 53.1, 633, 5/503.1, 131, 132, 308, 58, 904
See application file for complete search history.

(56) References Cited

U.S. PATENT DOCUMENTS

| | | | | | |
|---|---|---|---|---|---|
| 2,223,433 | A | * | 12/1940 | Sternberg | 40/584 |
| 3,171,139 | A | * | 3/1965 | Ziegenfuss | 5/53.1 |
| 3,389,411 | A | * | 6/1968 | Emery | 5/490 |
| 3,688,321 | A | * | 9/1972 | Moss et al. | 5/661 |
| 4,197,603 | A | * | 4/1980 | Greenhawk, Sr. | 5/630 |
| 4,937,905 | A | * | 7/1990 | Thaxton, Jr. | 5/661 |
| 5,193,238 | A | * | 3/1993 | Clute | 5/655 |
| 5,987,666 | A | * | 11/1999 | Zigmont | 5/424 |
| 6,097,294 | A | * | 8/2000 | Hilton | 340/573.1 |
| 6,804,845 | B2 | * | 10/2004 | Stewart et al. | 5/632 |
| 7,418,747 | B1 | * | 9/2008 | Myers | 5/308 |
| 7,475,441 | B1 | * | 1/2009 | Soberal | 5/655 |
| 8,375,487 | B1 | * | 2/2013 | Mohr et al. | 5/507.1 |

* cited by examiner

*Primary Examiner* — Michael Trettel
(74) *Attorney, Agent, or Firm* — Michael L. Greenberg, Esq.; Greenberg & Lieberman, LLC

(57) ABSTRACT

A triangular prism-shaped wedge, fashioned of a sturdy foam core with soft and malleable properties, fashioned to occupy the space that commonly exists between the head of a mattress and the wall or headboard that the mattress is binding against. It is configured to occupy this space, aided via the force of friction, to ensure that items such as pillows, remote controls, and other bedside items do not fall behind the mattress, and onto the floor. It may be configured with an assortment of interchangeable pockets, as well as an embedded stereo speaker system.

6 Claims, 5 Drawing Sheets

BED WEDGE

CONTINUITY DATA

This is a continuation of nonprovisional patent application Ser. No. 13/241,331 filed on Sep. 9, 2011 and priority is claimed thereto.

FIELD OF THE PRESENT INVENTION

The present invention, a triangular prism-shaped wedge fashioned of conventional foam and other materials, is designed to be placed at the head of a bed in the space typically found between the mattress of the bed and a wall or a headboard. The chief function of the present invention is to ensure items such as pillows, remote controls, eye glasses, and books and magazines do not fall into the space at the head of the bed.

BACKGROUND OF THE PRESENT INVENTION

Studies have recently shown that getting a good night's rest is more important than ever to an individual's health and overall quality of life. Depending on the age of an individual, some people require up to 10 full hours of sleep every night. Unfortunately, many factors compose the perfect night of sleep, including mattress comfort, bed placement, propensity for sound sleep (psychological factors), pillow comfort, and age. Unfortunately, in cases where an individual may move or change positions in his or her sleep, often the pillow may fall off the bed, either to the side, or behind the headboard, next to the wall, causing the individual discomfort, and potentially a sore neck from a lack of proper support upon waking. If there were a way to ensure that the pillow remained on the bed, rather than having the chance of falling behind the head of the bed, the inconvenience of dropping a pillow from the bed in one's sleep would be greatly diminished, thus increasing the likelihood of sound sleep.

Similarly, other activities typically occurring in bed, such as reading or watching television, can be impeded by the temporary loss of an item falling behind the head of the bed. For example, imagine a scenario where an individual falls asleep while watching television in bed, and happens to shift in his or her sleep, knocking the remote control behind the head of the bed in the process. Then, perhaps a loud noise from the still-running television show startles the individual awake, such as a gunshot in a movie, or a loud scream in a late-night horror film. The individual is now awake, searching for the remote to turn off the television, in order to promptly fall back asleep. Often if this activity takes more than a few seconds, the individual becomes fully awake, especially if the individual must turn on the light in order to locate the lost remote control. If there were a way to easily fill the gap commonly found between the mattress and the wall or headboard, the individual would be able to locate the lost remote quickly without getting out of bed or requiring additional lighting, could turn off the television, and return promptly to bed.

Other similar situations exist in which one would find it inconvenient to lose a personal item behind the head of the bed during the night. If one's eyeglasses were to fall behind the head of a bed due to the individual falling asleep wearing them, and the individual was not aware of where the glasses were upon waking, he or she could easily be late for work or an appointment. Thus there is a need for a device that could reliably fill the gap commonly found at the head of a conventional bed mattress, often between the headboard and the mattress, or the wall and the mattress.

U.S. Pat. No. 6,848,130 for "Bed Wedge Pad" by Wilson, issued on Feb. 1, 2005, shows a "bed pad wedge system" in which wedge-shaped barriers are fastened at edges of a mattress in order to prevent a person from falling out of the bed. Unlike the present invention, Wilson's invention is designed for placement at the sides of a mattress, whereas the present invention is designed to be placed in the gap between the mattress and a headboard.

U.S. Pub. No. 2008/0109961 for "Triangular Pillow" by Yu, published on May 15, 2008, shows a pillow "comprising a pillow body having a triangular shaped cross section". Although Yu appears similar in design to the present invention, it is designed to be used as a pillow, whereas the present invention is designed to fill the gap between a headboard and a mattress.

U.S. Pat. No. 7,328,471 for "Bedding Wedge System" by Stohr, issued on Feb. 12, 2008, shows a mattress in which one end is elevated higher than the other end. Unlike the present invention, Stohr is a mattress surface, whereas the present invention is designed to fill the gap between a mattress and a headboard.

SUMMARY OF THE PRESENT INVENTION

The present invention is an enclosure containing a triangular prism-shaped core fashioned to run the length of the head of a bed, and fashioned to occupy the space commonly found to exist between a mattress and a wall or a headboard. In the preferred embodiment of the present invention, the core is constructed of a dense, malleable material similar in composition to a conventional pillow. When in use, the present invention is compressed between the bed and the wall or the headboard, forming a lateral shelf between the bed and the wall or the headboard. The shelf is more rigid than the rest of the present invention that is not the shelf. The present invention is preferably secured in place via the friction existent by the force of the mattress weight compressing the present invention slightly, as it is pressed against the wall. In one embodiment of the present invention, a set of preferably rubber lateral slats may be affixed to the present invention in order to aid the stabilizing friction.

It is the intent of the present invention to provide the occupants of a bed with an added layer of security. The present invention will help to prevent items such as pillows, remote controls, books, eyeglasses, magazines, and other personal objects, from falling behind the head of the bed and onto the floor. In effect, the present invention forms a type of horizontal shelf when placed in the space commonly found to exist between the mattress and the wall or headboard in a typical bedroom. This space is commonly left open due to the fact that many bed frames are larger than the mattresses themselves, especially those designed to accommodate wheels that are configured for multiple bed sizes. This extra metal from the bedframe juts out slightly from the edge of the box spring it secures, commonly leaving a space between the mattress and box spring assembly and the wall or headboard that the bed frame rests against.

Preferably, the device would be stable yet flexible in order to conform to the bed, while simultaneously binding against the wall or headboard in order to remain in place. The present invention is designed to fit each specific standard United States mattress size: Twin, Full, Queen, Standard King and California King. It is envisioned that the present invention will be available in sizes corresponding to the length of mattresses as well as the width, in the event that the individual has placed his or her bed in the corner of a room and wishes to ensure items remain on the bed from both sides of the mattress in contact with the walls.

Embodiments of the present invention feature a stereo speaker system, as well as a variety of side pocket options, adding utility to the present invention.

DETAILED DESCRIPTION OF THE PREFERRED EMBODIMENT

The present invention is an elongated, triangular prism-shaped wedge designed to fit in the space between a conventional bed mattress and a wall or headboard. It is fashioned of a soft, yet durable and sturdy material, similar to a stiff pillow, with two triangular sides (50). The triangular sides (50) in the preferred embodiment are envisioned as isosceles triangles with the dimensions of 4×4×5 (although when compressed during use, the triangular sides (50) will assume shapes similar to right triangles).

Figure 1A:
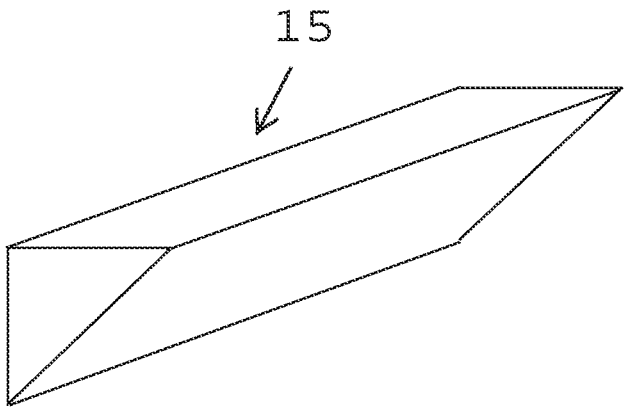
FIG. 1A shows the core (15) of the present invention and a front view of the enclosure (25) of the present invention.
Figure 1A:
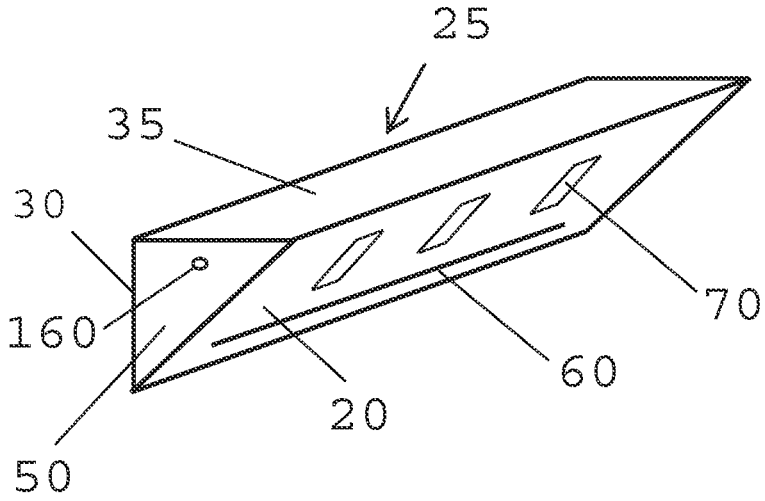

FIG. 1A shows the core (15) of the present invention and a front view of the enclosure (25). The core (25) is composed of a fire retardant, polyurethane, triangular-shaped material, preferably of one pound density with a rating of 32 Indentation Load Deflection (ILD). It is inserted into an enclosure (25) fashioned to snugly enclose the triangular prism shaped foam core (15). The enclosure (25) is available in an assortment of colors and textures, and is preferably made of a 100% polyester fabric. (Since the present invention is composed substantially of the enclosure (25) with the core (15) placed inside it, for ease of description the terms "enclosure" and "present invention" shall be used synonymously herein.) The enclosure (25) has a first side (30) (indicated but not shown in FIG. 1A, see FIG. 1B) serving as the "back side" that will be placed against the wall or headboard. The triangular sides (50) (only one of which is visible in FIG. 1A) have affixed to them at least one plastic snap (160) used to secure a pocket (210) (not shown in FIG. 1A, see FIG. 3 or FIG. 4) to the present invention. The shelf (35) of the enclosure (25) is the "top side" that will be facing upward when the present invention is inserted between the mattress and the wall or headboard. The hypotenuse (20) of the enclosure (25) is the "front side" that will be placed against the mattress, and affixed to the hypotenuse (20) are rubber lateral slats (70) to help keep the present invention in place, and a conventional zipper (60) by means of which the core (15) can be inserted into or removed from the enclosure (25).

Figure 1B:
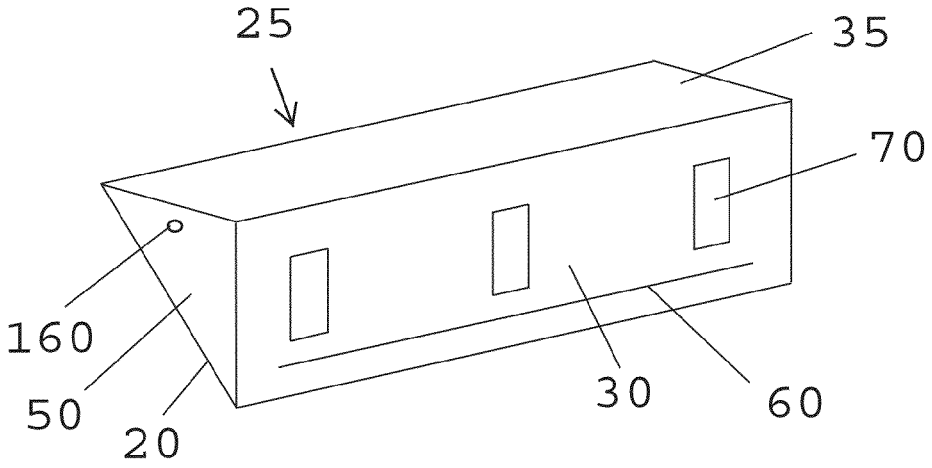
FIG. 1B shows a rear view of the enclosure (25) of the present invention.

FIG. 1B shows a rear view of the enclosure (25) of the present invention. The first side (30) of the enclosure (25) serves as the "back side" that will be placed against the wall or headboard. Affixed to the first side (30) are rubber lateral slats (70) to help keep the present invention in place, and a conventional zipper (60) by means of which the core (15) can be inserted into or removed from the enclosure (25). The triangular sides (50) (only one of which is visible in FIG. 1B) have affixed to them at least one plastic snap (160) used to secure a pocket (210) (not shown in FIG. 1B, see FIG. 3 or FIG. 4) to the present invention. The shelf (35) is the "top side" that will be facing upward when the present invention is inserted between the mattress and the wall or headboard, and the hypotenuse (20) (indicated but not shown in FIG. 1B, see FIG. 1A) is the "front side" that will be placed against the mattress.

Figure 1C:
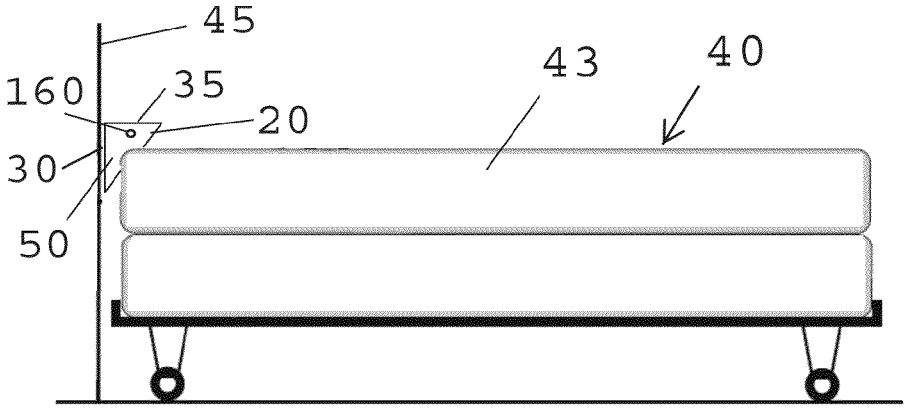
FIG. 1C shows a side view of the present invention placed in the space at the head of a bed mattress (40).

FIG. 1C shows a side view of the present invention placed in the space at the head of a bed mattress (40). FIG. 1C shows a direct view of one of the present invention's triangular sides (50), to which is affixed at least one plastic snap (160) used to secure a pocket (210) (not shown in FIG. 1C, see FIG. 3 or FIG. 4). The hypotenuse (20) (indicated but not shown in FIG. 1C, see FIG. 1A) is the "front side" placed against the mattress (40), leaving the first side (30) (indicated but not shown in FIG. 1C, see FIG. 1B) to form a friction point against the wall or headboard (45). When the present invention is positioned in this way, it serves the function of ensuring items such as pillows, eyeglasses, books and remote control devices do not fall behind the mattress (40) and onto the floor. It does this by forming the soft, pliable shelf (35) (indicated but not shown in FIG. 1C, see FIG. 1A or 1B) that runs along the entire length of the head of the mattress (40). This shelf (35) is not intended as a permanent place to hold items, but functions more like a safety mechanism, ensuring items remain on the mattress (40) and do not fall out of arm's reach. The present invention is held securely in place by the force of friction at two primary juncture points: against the mattress (40) and against the wall or headboard (45). When sufficiently wedged into this space between the mattress (40) and wall or headboard, the force of the present invention's foam-based core (15) (not shown in FIG. 1C, see FIG. 1A) expanding against the two juncture points causes the present invention to remain securely in place. As the present invention is compressed slightly and attempts to expand, the compression applies a counterforce against the mattress (40) and wall or headboard (45). Given that the mattress (40) weighs more than the present invention, the counterforce of the present invention attempting to decompress or expand is not enough to move the mattress (40) against the force of gravity combined with the force of static friction at the floor/bed frame juncture; therefore, the present invention attempts to expand within a relatively confined space, which maintains the present invention in its optimal position. Similarly, it is envisioned that the present invention could employ these same compressive forces when wedged into the space between the mattress (40) and the wall or headboard (45) from other angles. For example, the hypotenuse (20) (indicated but not shown in FIG. 1C, see FIG. 1A) could be angled against the wall or headboard (45), and the present invention would continue to function as intended. It is envisioned that the present invention would be available in an assortment of lengths in order to accommodate all bed sizes including, but not limited to, King, California King, Queen, Twin, and Double sized beds. However, the overall ratio of the triangular sides (50) (only one of which is shown in FIG. 1C) would preferably remain the same for all lengths, that is 4×4×5 (with the preferred embodiment envisioned as 4 inches×4 inches×5 inches). It is envisioned that the present invention will also be available in sizes corresponding to the length of a conventional mattress (40), so that a bed wedge can be placed between a lengthwise side (43) of a mattress (40) and a wall.

Figure 2:
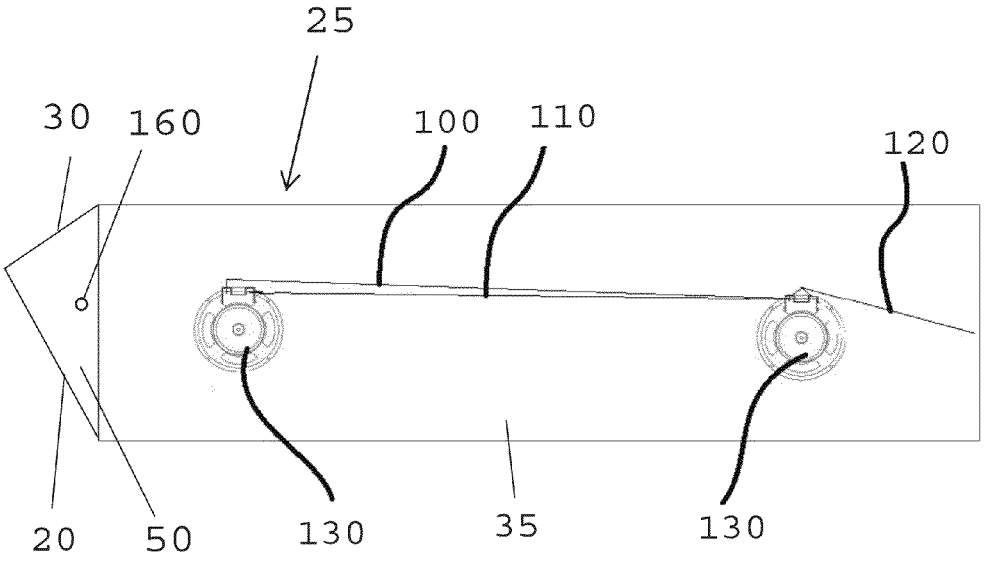
FIG. 2 exhibits an embodiment of the present invention as viewed from above, with the speakers (130) equipped.

FIG. 2 shows a top view of the preferred embodiment of the enclosure (25) when it is installed in the gap between a mattress and headboard or wall. This top view affords a detailed look at the shelf (35) of the present invention, that is the portion that faces upward when the present invention is placed between a mattress and a wall. (The hypotenuse (20) (indicated but not shown in FIG. 2, see FIG. 1A) is the portion that will be placed against the mattress, and the first side (30) (indicated but not shown in FIG. 2, see FIG. 1B) will be placed against the headboard or wall. For purposes of orientation, one of the triangular sides (50) and one of the snaps (160) are also shown in FIG. 2.) The present invention is shown equipped with a stereo speaker system embedded within the core (15) (not shown in FIG. 2, see FIG. 1A). Shown are two speakers (130) at points preferably equidistant from the center of the shelf (35), the speakers (130) connected via conventional speaker wires, one positive wire (100) and one negative wire (110), to carry the audio signal from an amplifier (not shown) to the speakers (130). An adequate amount of slack is envisioned for both the positive wire (100) and the negative wire (110) within the interior of the foam-based core (15) (not shown in FIG. 2, see FIG. 1A) in order to prevent accidental disconnection of the speakers (130) due to the nature of the present invention's flexibility and mobility. The speakers (130) are preferably equipped with a conventional 2.5 mm or 3.5 mm headphone audio cable (120), enabling the speakers (130) to be connected to a wide variety of MP3 players, CD players, tape players, iPods, cellphones, and other devices sharing a male 2.5 mm or 3.5 mm audio plug.

Figure 3:
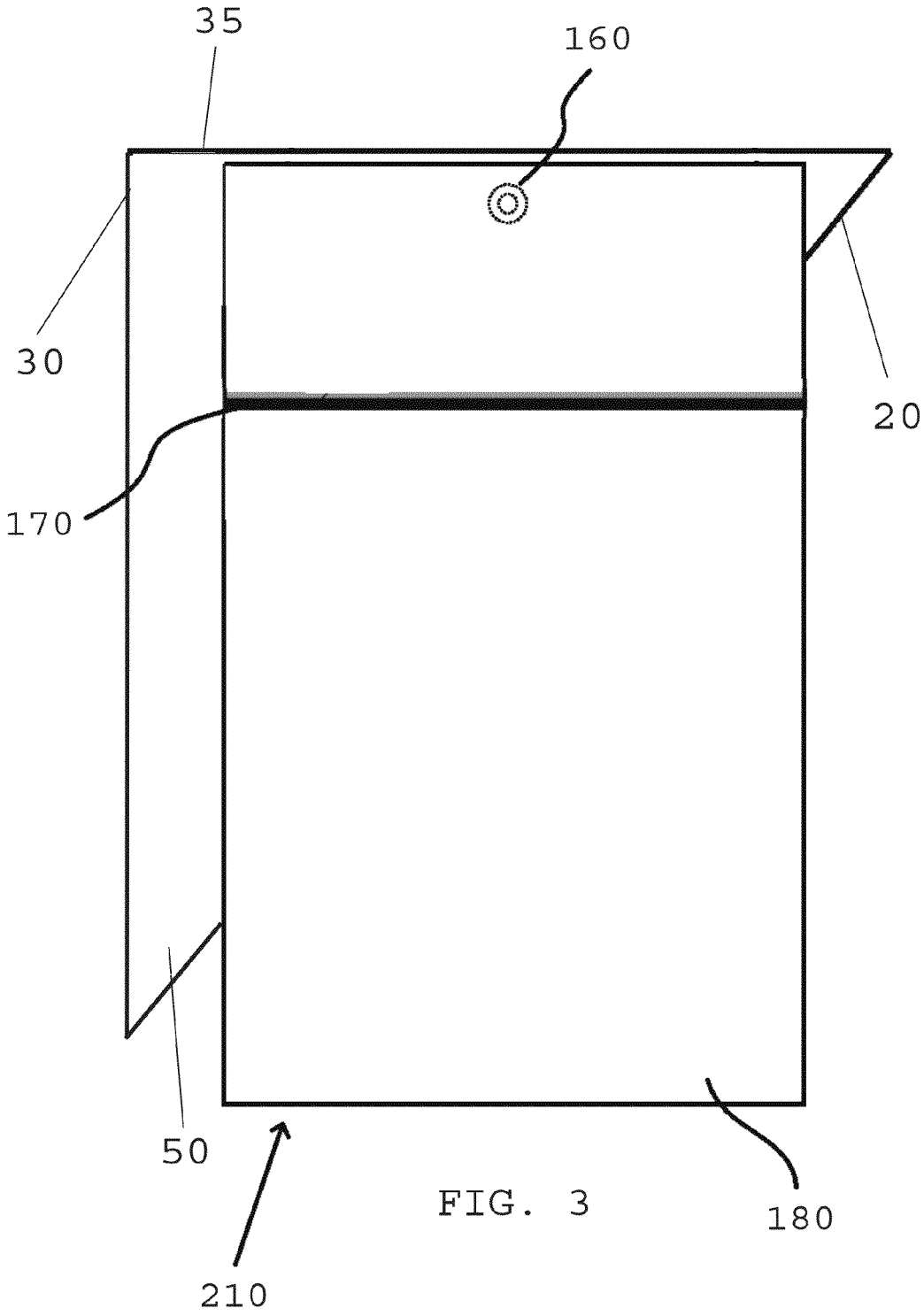
FIG. 3 displays a side view of the present invention, with the preferred embodiment of the side pockets (210).

Referring to FIG. 3, the present invention is also equipped with two optional pockets (210) (only one of which is visible in FIG. 3), with one pocket (210) placed on each side of the present invention, that serve as bedside storage for items such as eyeglasses or an MP3 player. FIG. 3 shows a side view of the preferred embodiment of the pocket (210), exhibiting the pocket (210) attached to the present invention's triangular sides (50) (only one of which is visible in FIG. 3). The pocket (210) is attached by a single snap (160), affixed to the triangular side (50), that attaches to a conventional opening (not shown) at the top center of the pocket (210). The pocket (210) of the present invention is preferably made of a piece of thin plastic with a pocket lining (180) accessible by an opening (170). The lining (180) is preferably in the shape of a rectangle with a width the same size as the pocket (210). It is envisioned that the pockets (210) are to be near enough to the 3.5 mm or 2.5 mm audio cable (120) (not shown in FIG. 3, see FIG. 2) so that the media device (such as an MP3 player) supplying the audio to the speakers (130) (not shown in FIG. 3, see FIG. 2) is able to fit securely in one of the pockets (210). The embodiment shown in FIG. 3 employing a single snap (160) is preferred because it enables the affixed pockets (210) of the present invention to hang freely off of the triangular sides (50) and remain oriented with the ground. Also denoted in FIG. 3, for purposes of orientation, are the hypotenuse (20) (indicated but not shown in FIG. 3, see FIG. 1A), the first side (30) (indicated but not shown in FIG. 3, see FIG. 1B), and the shelf (35) (indicated but not shown in FIG. 3, see FIG. 1A).

Figure 4:
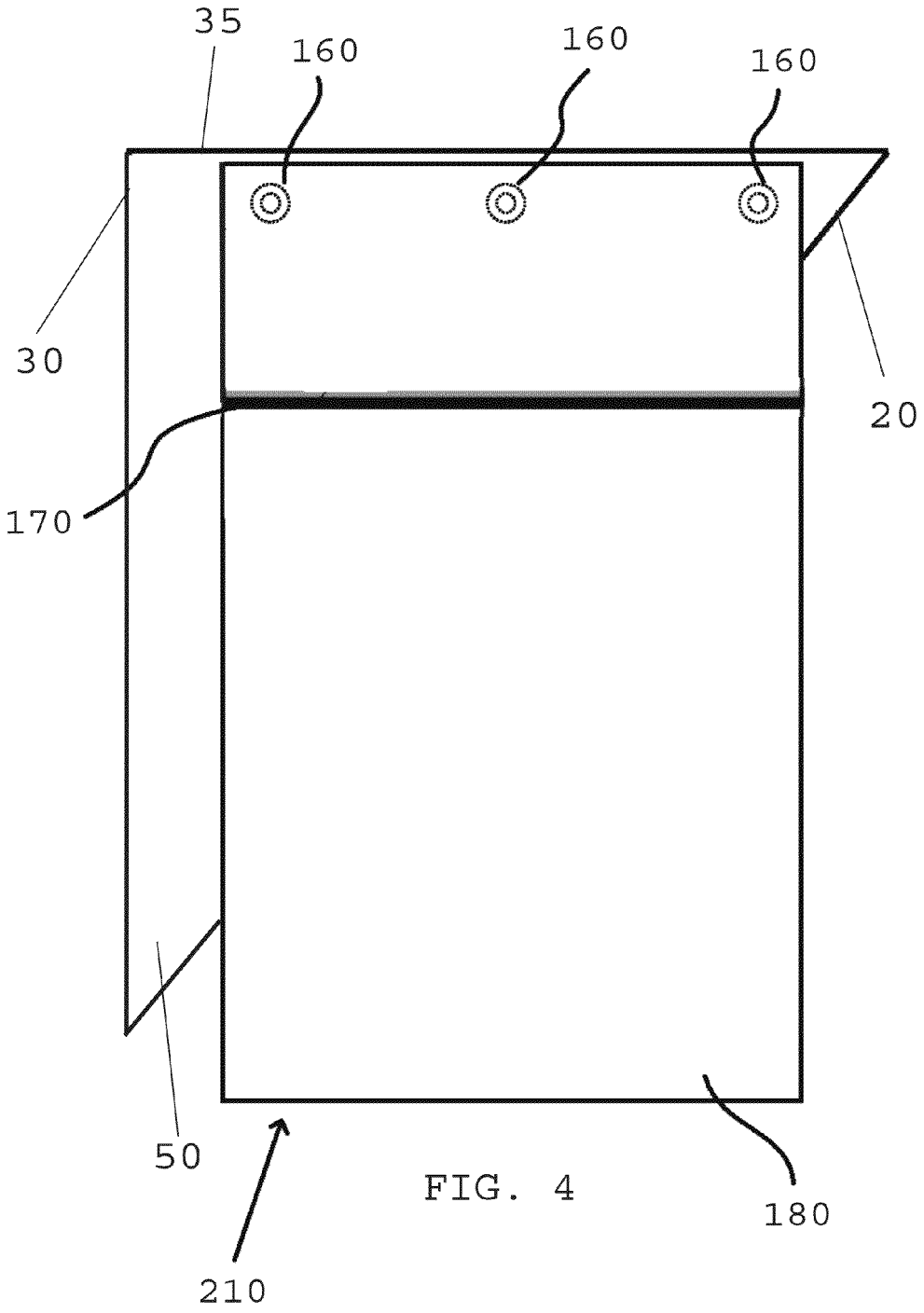
FIG. 4 displays another embodiment of the present invention with the side pockets (210) attached.

FIG. 4 shows another embodiment of the pockets (210) (only one of which is shown in FIG. 4), the pocket (210) attached to the triangular sides (50) (only one of which is shown in FIG. 4) by means of three snaps (160). The three snaps (160), affixed to the triangular side (50), attaches to three conventional openings (not shown) at the top center of the pocket (210). The pocket (210) of the present invention is preferably made of a piece of thin plastic with a pocket lining (180) accessible by an opening (170). The lining (180) is preferably in the shape of a rectangle with a width the same size as the pocket (210). It is envisioned that the pockets (210) are to be near enough to the 3.5 mm or 2.5 mm audio cable (120) (not shown in FIG. 4, see FIG. 2) so that the media device (such as an MP3 player) supplying the audio to the speakers (130) (not shown in FIG. 4, see FIG. 2) is able to fit securely in one of the pockets (210). Also denoted in FIG. 4, for purposes of orientation, are the hypotenuse (20) (indicated but not shown in FIG. 4, see FIG. 1A), the first side (30) (indicated but not shown in FIG. 4, see FIG. 1B), and the shelf (35) (indicated but not shown in FIG. 4, see FIG. 1A).

In addition, it can be envisioned that the snaps (160) found on the present invention may be used to accommodate differing types of accompanying pockets (210). For example, pocket options could include but are not limited to the following applications: remote pouch, eyeglass pouch, flashlight pouch, Pen/Pencil/Paper pouch, iPod/MP3 pouch. Each pouch or pocket would be of a slightly differing shape and size, in order to accommodate differently sized items effectively. These alternative pouches would all employ the same snaps (160) implemented in all embodiments of the present invention.

Furthermore, alternate embodiments of the present invention could include an economy unit that does not include the embedded stereo speakers (130) found in the preferred embodiment of the present invention. This would drop the retail price of the present invention, and would make the retail unit lighter. It is envisioned that, rather than speakers (130) embedded within the core (15) of the present invention, this embodiment of the present invention would utilize the same foam-based material to occupy the entirety of the core's structure.

Similarly, in another embodiment, the present invention could exhibit additional speakers, such as a third center speaker. In this advanced audio configuration, the present invention may employ a powered speaker system, implementing the use of batteries or conventional AC power to drive the enhanced sound. In this case, a traditional AC adaptor would be used to provide power to amplify the audio output.

The present invention is in no way manufactured, sold or implied to have any intention of being used in conjunction with a person's body, to prevent entrapment of a person's body or limb, or for any medical applications or purposes. Similarly, while the present invention may share some properties with a pillow, such as softness, it is not designed nor intended to be used as such. While the present invention may not directly prevent the entrapment or binding of an individual's limb within the mattress, box spring, and bed frame assembly, but rather, by preventing items from falling behind the mattress, box spring, and bed frame assembly, an individual is far less likely to place his or her hand in potential danger in an attempt retrieve a fallen item.

It should be understood that the present invention is a device for a bed, comprising an enclosure (25); and a core (15), inside the enclosure (25), the core (15) having a rigid shelf (35) compared to the rest of the core (15), the core (15) having a prism shape; further comprising at least one speaker (130) in communication with the core (15); further comprising at least one speaker (130) embedded within the core; further comprising a set of rubber lateral slats (70), in communication with the enclosure (25); further comprising at least one pocket (210) on the enclosure (25); further comprising at least one pocket (210) on the enclosure (25), the at least one pocket (210) configured to hang freely off the side of the enclosure (25); further comprising at least one pocket (210) on the enclosure (25), the at least one pocket (210) configured to hang freely off the side of the enclosure (25) via at least one snap (160); further comprising a lining (180) inside the at least one pocket (210).

Furthermore, it should be understood that the present invention is a method of using a device for a bed, comprising frictionally forcing the hypotenuse (20) of a core (15) against a mattress (20); frictionally forcing a first side (30) of the core (15) against a wall or a headboard; allowing a core (15) to compress against the mattress and the wall or the headboard to hold the core (15) firmly in place between the mattress and the wall or the headboard; and thus, creating a shelf (35) between the mattress and the wall or the headboard; further comprising securing the core (15) against the mattress and the wall or the headboard via rubber slats (70); wherein the rubber slats (70) are disposed vertically on the core (15) in a fashion perpendicular to a plane of the mattress.

Finally, it should be understood that the present invention is not solely limited to the invention as described in the embodiments above, but further comprises any and all embodiments within the scope of this application.

The invention claimed is:

1. A device for a bed comprising:

a triangular prism shape, said triangular prism shape having a first triangular end and a second triangular end;

wherein said first triangular end and said second triangular end are isosceles triangles, and further comprising a set of rubber lateral slats, in communication with said triangular prism shape.

2. A device for a bed comprising:

a triangular prism shape, said triangular prism shape having a first triangular end and a second triangular end;

wherein said first triangular end and said second triangular end are isosceles triangles; and further comprising at least one pocket on said triangular prism shape, said at least one pocket configured to hang freely off the side of said triangular prism shape.

3. A method of using a device for a bed, comprising:

frictionally forcing a first side of a shape against a mattress against a mattress;

frictionally forcing a second side of the shape against a wall or a headboard;

allowing shape to compress against the mattress and the wall or the headboard to hold the shape firmly in place between the mattress and the wall or the headboard; and thus, creating a barrier between the mattress and the wall or the headboard.

4. The method of claim 3, further comprising securing the shape against the mattress and the wall or the headboard via rubber slats.

5. The method of claim 4, wherein the rubber slats are disposed vertically on the shape in a fashion perpendicular to a plane of the mattress.

6. The device of claim 3, further comprising hanging freely a pocket off the side affixing at least one pocket that hangs freely.

* * * * *